US007234882B2

(12) United States Patent
Takada et al.

(10) Patent No.: US 7,234,882 B2
(45) Date of Patent: Jun. 26, 2007

(54) DATA PRODUCING METHOD OF DATA PRODUCING APPARATUS, DATA PRODUCING APPARATUS, AND SHEET PROCESSING APPARATUS

(75) Inventors: Makoto Takada, Shiojiri (JP); Seiji Tanaka, Agrumino (JP); Takayuki Uehara, Koshigoya (JP)

(73) Assignees: Seiko Epson Corporation, Tokyo (JP); King Jim Co., Ltd., Tokyo (JP)

( * ) Notice: Subject to any disclaimer, the term of this patent is extended or adjusted under 35 U.S.C. 154(b) by 0 days.

(21) Appl. No.: 11/400,083

(22) Filed: Apr. 6, 2006

(65) Prior Publication Data

US 2006/0228147 A1 Oct. 12, 2006

(30) Foreign Application Priority Data

Apr. 11, 2005 (JP) ..... 2005-113939

(51) Int. Cl.
*B41J 3/32* (2006.01)

(52) U.S. Cl. ..... 400/109.1; 400/483

(58) Field of Classification Search ..... 400/109.1, 400/483

See application file for complete search history.

(56) References Cited

U.S. PATENT DOCUMENTS 7,112,000 B2 * 9/2006 Kurashina et al. ..... 400/109.1

2006/0120788 A1 * 6/2006 Takahashi ..... 400/109.1

FOREIGN PATENT DOCUMENTS

JP 2001-088358 4/2001

* cited by examiner

*Primary Examiner*—Minh Chau
(74) *Attorney, Agent, or Firm*—Hogan & Hartson LLP

(57) ABSTRACT

A data producing apparatus has: a first Braille translation device producing information processing Braille data for embossing information processing Braille on a processing sheet based on an ink-character array having one or more ink characters; a second Braille translation device producing general Braille data for embossing general Braille, other than the information processing Braille, on the processing sheet based on the ink-character array, thereby producing from the inputted ink-character array Braille data having the information processing Braille data and/or the general Braille data. A data producing method includes: when designation of producing part or all of the inputted ink-character array in information processing Braille is made, producing the information processing Braille data with the first Braille translation device for the designated portion; and when designation of producing in general Braille is made, producing the general Braille data with the second Braille translation device for the designated portion.

11 Claims, 8 Drawing Sheets

(NOTE: In D16, for example, "INPUT" is in Japanese hiragana denoting inputted character array as it is, and "TRANSLATION" is in Japanese katakana written according to Braille translation rules. "TRANSCRIPTION" denotes Braille characters (in six-point system) corresponding to Japanese language, not to English. The same applies to other relevant figures.)

DATA PRODUCING METHOD OF DATA PRODUCING APPARATUS, DATA PRODUCING APPARATUS, AND SHEET PROCESSING APPARATUS

The entire disclosure of Japanese Patent Application No. 2005-113939, filed Apr. 11, 2005, is expressly incorporated by reference herein.

BACKGROUND

1. Technical Field

The present invention relates to: a data producing method of a data producing apparatus which produces Braille data for embossing Braille on a processing sheet; a data producing apparatus; and a sheet processing apparatus.

2. Related Art

There is known a sheet processing apparatus which uses a Braille character printing device to perform embossing of Braille characters in a Braille character printing region while feeding a processing sheet at a given pitch. In this kind of sheet processing apparatus, when the user inputs ink characters (i.e., characters ordinarily printed with ink), Braille data is produced based on the inputted ink characters. Then, based on the produced character data, the embossing device is controlled to be driven to emboss the Braille characters desired by the user on the processing sheet. JP-A-2001-88358 is an example of related art.

In Japanese Braille notating the Japanese language, information processing Braille must be used in notating the URL (uniform resource locator) or electronic mail address, or the like. The notation in information processing Braille is made in a different manner from that of general Braille (i.e., Braille which is other than information processing Braille). In other words, in order to use correct Braille notation, it is necessary to separately use the general Braille and the information processing Braille depending on the contents of the sentences (information). In case Braille data is produced based on the ink characters, it is necessary to produce from the ink characters Braille data for embossing general Braille and Braille data for embossing information processing Braille.

SUMMARY

It is an advantage of the invention to provide a data processing method for a data producing apparatus, a data producing apparatus, and a sheet processing apparatus, in all of which Braille data for embossing general Braille and Braille data for embossing information processing Braille are produced based on inputted ink characters, thereby enabling to emboss Braille characters of a suitable Braille notation.

According to one aspect of the invention, there is provided a data producing method for a data producing apparatus, the apparatus comprising: data producing method for a data producing apparatus. The apparatus comprises: a first Braille translation device which produces information processing Braille data for embossing information processing Braille on a processing sheet based on an ink-character array made up of one or more ink characters; a second Braille translation device which produces general Braille data for embossing general Braille, other than the information processing Braille, on the processing sheet based on the ink-character array, thereby producing from the inputted ink-character array Braille data made up of the information processing Braille data and/or the general Braille data. The method includes: when designation of producing part or all of the inputted ink-character array in information processing Braille is made, producing the information processing Braille data with the first Braille translation device for the designated portion; and when designation of producing in general Braille is made, producing the general Braille data with the second Braille translation device for the designated portion.

According to another aspect of the invention, there is provided a data producing apparatus comprising: a first Braille translation device which produces information processing Braille data for embossing information processing Braille on a processing sheet based on an ink-character array made up of one or more ink characters; a second Braille translation device which produces general Braille data for embossing general Braille, other than the information processing Braille, on the processing sheet based on the ink-character array; and a Braille kind designation device which designates whether part or all of the inputted ink-character array shall be produced in information processing Braille or general Braille; and a Braille data producing device which produces, based on a result of designation by the Braille kind designation device, the information processing Braille data with the first Braille translation device for the portion in which producing by information processing Braille of the ink-character array is designated, and which produces the general Braille data with the second Braille producing device for the portion in which producing by general Braille of the ink-character array is designated, thereby producing Braille data which is made up of information processing Braille data and general Braille data from the inputted ink-character array.

According to the above configurations, a part of the whole of the inputted ink-character array is designated as the information processing Braille and the remaining part thereof is designated as the general Braille. Depending on this designation, the inputted ink-character array is translated (converted) into the information processing Braille data or general Braille data. In other words, an arbitrary range of the inputted ink-character array can be designated into the information processing Braille. The ink characters constituting the ink-character array can thus be arbitrarily converted into general Braille data or information processing Braille data.

It is preferable that the apparatus further comprises a first display device for displaying: inputted ink-character notation for notating ink characters based on the inputted ink-character array; produced Braille notation for notating transcribed Braille based on the produced Braille data; and produced ink-character notation of Braille for notating the ink-character translation of the Braille.

According to this configuration, the first display device makes it possible to confirm the inputted ink-character array in ink-character notation and also to confirm the result of translation (transcription) of the ink-characters into Braille according to the Braille rules, in Braille characters in the form of produced Braille notation as well as in ink characters in the form of notation of Braille as translated or transliterated.

It is preferable that the first display device comprises an indication mark display device which displays by indicating the portion corresponding to the general Braille separately from at least one of the portions of the inputted ink-character notation and produced ink-character notation corresponding to the information processing Braille, at a time of displaying the information processing Braille as the produced Braille notation.

According to this configuration, by means of the displayed indication mark in ink-character notation, it can be easily grasped as to whether the inputted ink characters shall be translated (or transcribed) into general Braille or into information processing Braille. In addition, by means of the displayed indication mark as displayed in the produced ink-character notation of Braille, it can be easily grasped as to whether the information processing Braille is included in the translated (or transcribed) Braille.

It is preferable that the indication mark display device respectively inserts as the indication mark display: a starting mark in a position corresponding to a position of starting the information processing Braille in the inputted ink-character notation and the produced ink-character notation; and an end mark in a position corresponding to a position of ending the information processing Braille in the inputted ink-character notation and the produced ink-character notation.

According to this configuration, among the inputted ink characters, the range to be converted into the information processing Braille can be easily recognized and also the range as converted into the information processing Braille can be easily recognized.

It is preferable that the apparatus further comprises an enclosing sign setting device which sets, when the Braille kind designation device has selected producing in the information processing Braille, as to whether enclosing signs shall be added to the information processing Braille data produced by the first Braille translation device to indicate a starting point and an end point of the information processing Braille. The Braille data producing device produces, when setting is made to add the enclosing signs, the Braille data in which enclosing data to emboss the enclosing signs is added to the information processing Braille data produced by the first Braille translation device.

According to this configuration, when the information processing Braille data is produced, a selection can be made as to whether the enclosing marks shall be added or not. As a result, although basically the enclosing marks are added in the information processing Braille, a selection can also be made to positively omit the enclosing signs to reduce the number of cells to the extent possible in case, e.g., of a label for attaching to a name card, or the like, is produced.

It is preferable that the apparatus further comprises: a first display device for displaying an inputted ink-character notation for notating ink characters based on the inputted ink-character array, produced Braille notation for notating the transcription of Braille based on the produced Braille data, and produced ink-character notation for notating the translation of the Braille. The first display device includes an indication mark display device which displays by indicating the portion corresponding to the general Braille separately from at least one of an inputted ink-character notating portion and a produced ink-character notating portion corresponding to the information processing Braille, and the indication mark display device displays the indication mark in a different indicating mode, based on a result of setting by the enclosing sign setting device, between a case in which the enclosing signs are embossed and a case in which the enclosing signs are not embossed.

According to this configuration, by the indication mark displayed in the inputted ink-character notation, it can be easily grasped as to whether the inputted ink characters shall be translated into information processing Braille or not. Further, by the indication mark as displayed in the produced ink-character notation of Braille, it can be easily grasped as to whether the information processing Braille is included in the transcribed Braille or not. Still furthermore, the setting as to whether the enclosing signs shall be added to the information processing Braille can be easily recognized by the indication sign display.

It is preferable that the apparatus further comprises: Braille data input device which inputs the Braille data; and ink-character translation device which translates the Braille data into the ink-character array.

According to this configuration, since the apparatus further comprises Braille data input device which inputs the Braille data, and ink-character translation device which translates the Braille data into ink characters, the contents of the inputted Braille data can be easily converted into ink characters (ink-character array).

It is preferable that the apparatus further comprises a second display device which displays an input Braille notation which notates the Braille based on the inputted Braille data and displays input ink-character translation notation which notates ink-character translation of the Braille as notated in the inputted ink-character.

According to this configuration, the contents of the inputted Braille data can be confirmed by the ink characters as displayed in the input ink-character translation notation.

It is preferable that, when the enclosing sign data to emboss the enclosing signs showing the starting point and the end point of the information processing Braille is inputted by the Braille data input device as the Braille data, the second display device displays in the input ink-character translation notation an enclosing sign mark corresponding to the enclosing sign data.

According to this configuration, the enclosing sign mark facilitates easy recognition that the Braille data contains information processing Braille as well as the range of the information processing Braille.

According to yet another aspect of the invention, there is provided a sheet processing apparatus comprising: the above-referenced data producing apparatus; and an embossing device which embosses Braille on the processing sheet based on the Braille data produced by the data producing apparatus.

According to this configuration, there is provided the data producing apparatus which is capable of producing both the general Braille and the information processing Braille by appropriately selecting the kind of Braille while inputting the ink characters. Therefore, based on the input of the ink characters, general Braille and the information processing Braille can be embossed. In addition, since both the general Braille and the information processing Braille can be embossed by the inputting of ink characters, even the user who is not familiar with the Braille, general Braille and the information processing Braille can emboss Braille in a manner in which the general Braille is separated from the information processing Braille.

BRIEF DESCRIPTION OF THE DRAWINGS

The invention will be described with reference to the accompanying drawings, wherein like numbers reference like elements.

DESCRIPTION OF EXEMPLARY EMBODIMENTS

With reference to the accompanying drawings, a description will be made about a label forming apparatus to which this invention is applied. This label forming apparatus is constituted so as to be capable of performing ink-character printing and Braille embossing on a processing tape so as to produce a Braille tape which can be recognized by both blind or visually impaired people and sighted people. In concrete, ink-character printing is performed on the processing tape. The printed portion of the tape is cut to thereby obtain a tape piece (or a piece of tape) to form a label. This tape piece is subjected to Braille embossing to thereby obtain a (Braille) label.

Figure 1:
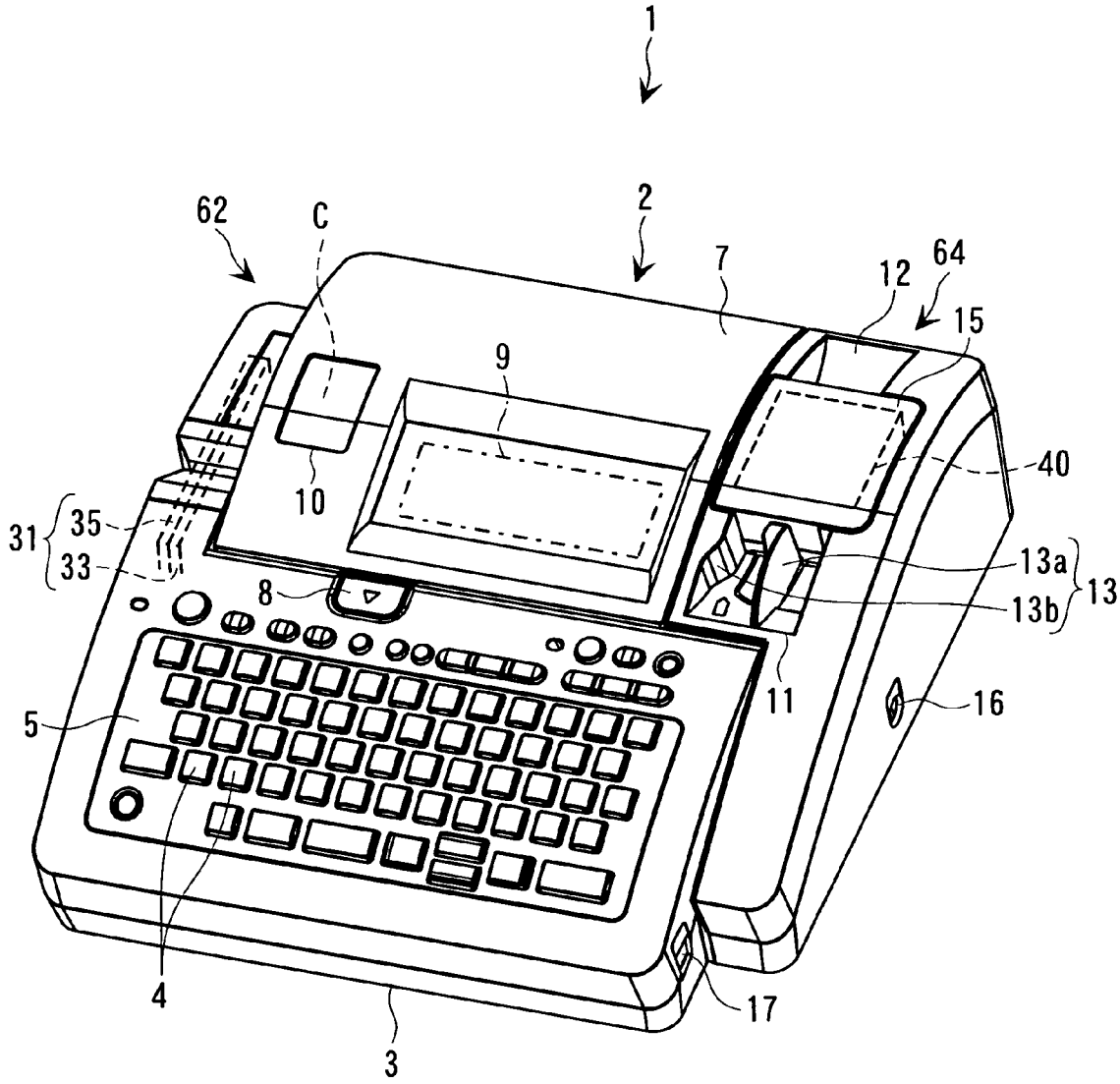
FIG. 1 is an outside perspective view of a label producing apparatus with a lid kept closed.
Figure 2:
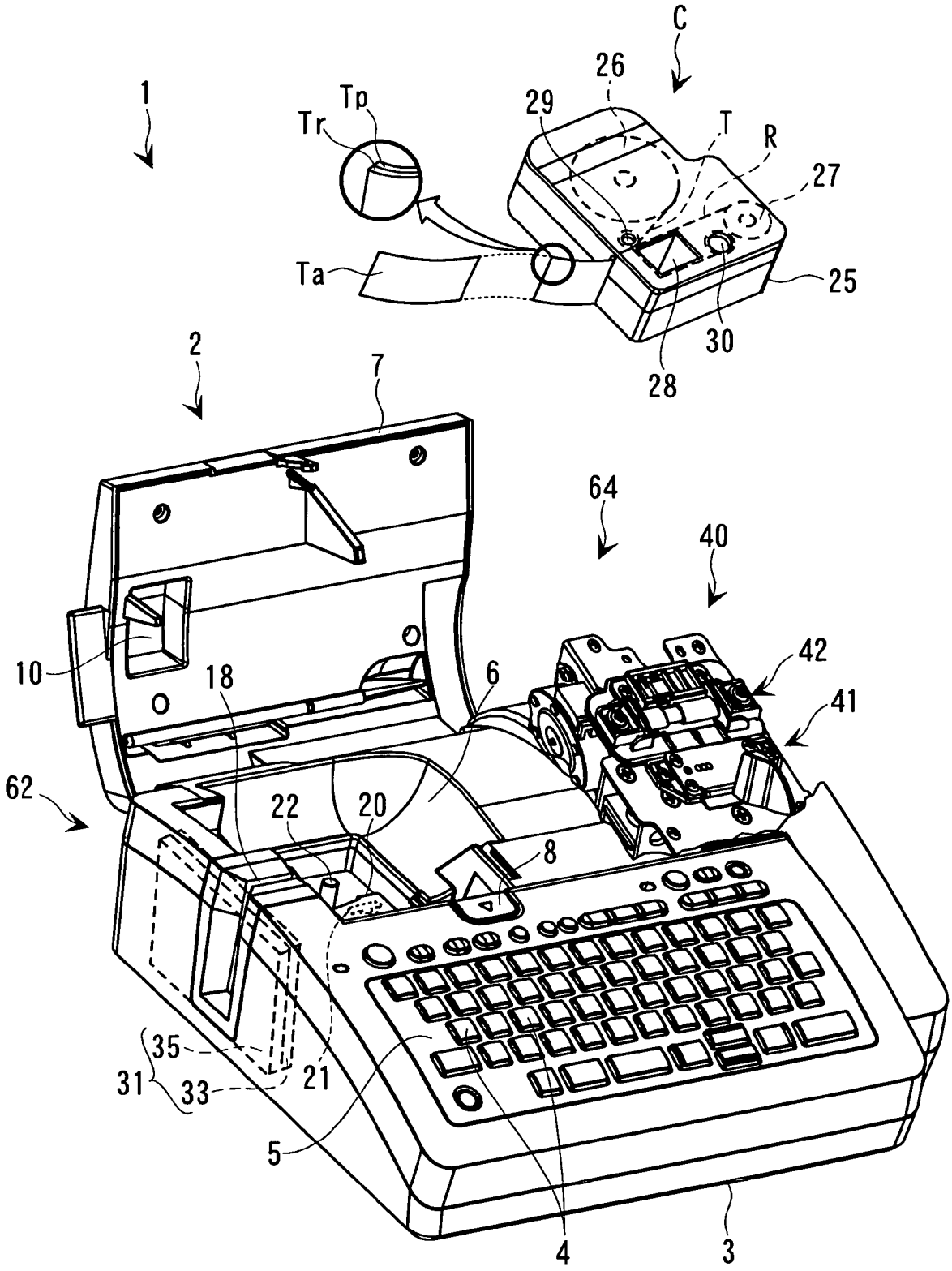
FIG. 2 is an outside perspective view with the lid left open.

As shown in FIGS. 1 and 2, the label forming apparatus 1 is made up of: an apparatus main body 2 which performs ink-character printing on a processing tape T and which also performs Braille embossing on the tape piece Ta obtained from the processing tape T; and a tape cartridge C which contains therein the processing tape T and an ink ribbon R.

The apparatus main body 2 is made up of an apparatus casing 3 which serves as an outer shell of the apparatus. An ink-character printing section 62 is disposed in a relatively wide area therein. On a right rear half of the apparatus casing 3, there is constituted a Braille embossing section 64. It is to be noted that reference to the right and left as well as to the front and rear is made as seen from the side of the operator. On a front (i.e., this side) upper half portion of the apparatus casing 3, there is disposed a keyboard 5 which is provided with various keys 4 inclusive of character keys and function keys (selection key, "printing" key, Braille translation key, shift key, or the like). On an upper rear portion of the apparatus casing 3, there is provided an open/close lid 7, and a lid opening button 8 is provided in the front of the open/close lid 7. When the lid open button 8 is pushed to thereby open the open/close lid 7, there appears a cartridge mounting portion 6 which is formed in a recessed manner and into which is mounted the tape cartridge C. On the front side of the open/close lid 7, there is formed a rectangular display 9 for displaying the results of inputting, or the like, from the keyboard 5.

On the left side of the apparatus casing 3, there is formed a print-tape ejecting slot 18 which communicates the cartridge mounting portion 6 and the outside of the apparatus together. In a manner to face the print-tape ejecting slot 18, the apparatus casing 3 has housed therein a cutter unit 31 which cuts the processing tape T. The cutter unit 3 has: a full cutter 33 which is driven by a motor (full cutter motor 32) so as to cut the processing tape T in a style of a pair of scissors to thereby form a tape piece Ta; and a half cutter 35 which is of a style of a pair of scissors with a stopper and is driven by a motor (half cutter motor 34) to cut only a recording tape Tr of the processing tape T.

On the upper rear half portion of the apparatus casing 3, there is disposed a Braille embossing section 64 which is made up of: an embossing assembly 40 which constitutes the main body of the Braille embossing section 64; an embossing tape inserting slot (sheet inserting slot) 11 into which the tape piece Ta is manually inserted from the front side with the printing surface of the tape piece Ta facing upward; and an embossed tape discharging slot 12 which discharges the embossed tape piece Ta in a direction away from the operator. The embossing tape inserting slot 11 is provided with a manual insertion guide 13 whose width can be adjusted. Reference numeral 15 in FIG. 1 denotes a cover which covers the embossing assembly 40.

On the right side of the apparatus casing 3, there are formed a power supply port 16 for supplying power to the label forming apparatus 1, and a UBS connector 17 for connection to an outside apparatus such as data producing apparatus. In other words, the label forming apparatus 1 is so arranged that, by connecting to the outside apparatus, the ink-character printing and the Braille embossing can be performed based on the character information generated by the outside apparatus. Further, inside the apparatus casing 3, there is mounted a circuit board (not shown) which constitutes the control section 60 for performing an overall control of the apparatus main body 2.

The cartridge mounting portion 6 has mounted therein in a projecting manner: a printing head 21 (thermal head) which has a heating element and is covered with a head cover 20; a positioning boss 22 which aligns the position of a tape reel 26 which is described hereinafter; a platen driving shaft (not shown) which feeds the processing tape T and ink ribbon R of the tape cartridge C and which lies opposite to the printing head 21; and a take-up driving shaft (not shown) which takes up the ink ribbon R. At a corner of the cartridge mounting portion 6, there is provided a tape identifying sensor 23 (see FIG. 4) which is made up of a plurality of microswitches. On an inner side of the bottom plate of the cartridge mounting portion 6, there is built in a printing feed motor which drives the platen driving shaft and the take up driving shaft, a reduction gear train, or the like.

As shown in FIG. 2, the tape cartridge C contains, inside the cartridge casing 25, a tape reel 26 around which is wound the processing tape T and, in the right bottom portion thereof, a ribbon pay out reel 27 around which is wound the ink ribbon R and a ribbon take-up reel 30. On the left lower portion of the tape reel 26, there is formed a through hole 28 for inserting into the head cover 20 which covers the printing head 21. Further, in a position to correspond to the portion in which the processing tape T and the ink ribbon R are overlapped with each other, there is disposed a platen roller 29 which is driven for rotation by fitting with the platen driving shaft.

The processing tape T is made up of: the recording tape Tr of polythlene terephthalate (PET) make having coated an adhesive agent layer on a rear surface thereof; and a release tape Tp of PET make having adhered to the recording tape Tr by means of the adhesive agent layer, and is contained inside the cartridge casing 25 in a state of being wound into a roll. The processing tape T is available in plural kinds of different tape widths. On the rear surface of the cartridge casing 35, there are formed a plurality of detection holes (not shown) for identifying the kind of the processing tape T.

When the open/close lid 7 is opened and the tape cartridge C is mounted into the cartridge mounting portion 6, the head cover 20 is inserted into the through hole 28, the tape reel 26 is inserted into the positioning boss 22, the take-up reel 30 is inserted through the take-up driving shaft, and the platen roller 29 is inserted through the platen driving shaft, respectively. At the same time, the tape identifying sensor 23 is made ready to detect the plurality of detection holes formed in the cartridge casing 25. When the open/lid cover 7 is closed in this state, the printing head 21 comes into contact, in a manner interlocked with the operation, with the platen roller 29 with the processing tape T and the ink ribbon R sandwiched therebetween, thereby attaining a state of standby for printing.

The ink-character printing is performed based on the printing data contained in the label data, while feeding the processing tape T and the ink ribbon R through periodic rotation of the platen driving shaft and the take-up driving shaft by driving the printing head 21. At this time, the ink ribbon R paid out of the ribbon pay-out reel 27 travels round the opening wall of the through hole 28 and is taken up by the ribbon take-up reel 30. The processing tape T having printed ink characters thereon is subjected to half cutting by the half cutter 35 at a predetermined position, and the printed portion is thereafter subjected to full cutting by the full cutter 33. The cut tape piece Ta is ejected out of the pint-tape ejecting slot 18. As a result of this half cutting, a waste margin (not shown) is formed in the tape piece Ta at the front end (or leading edge) as seen in the direction of manual insertion thereof into the embossing assembly 40.

Figure 3A:
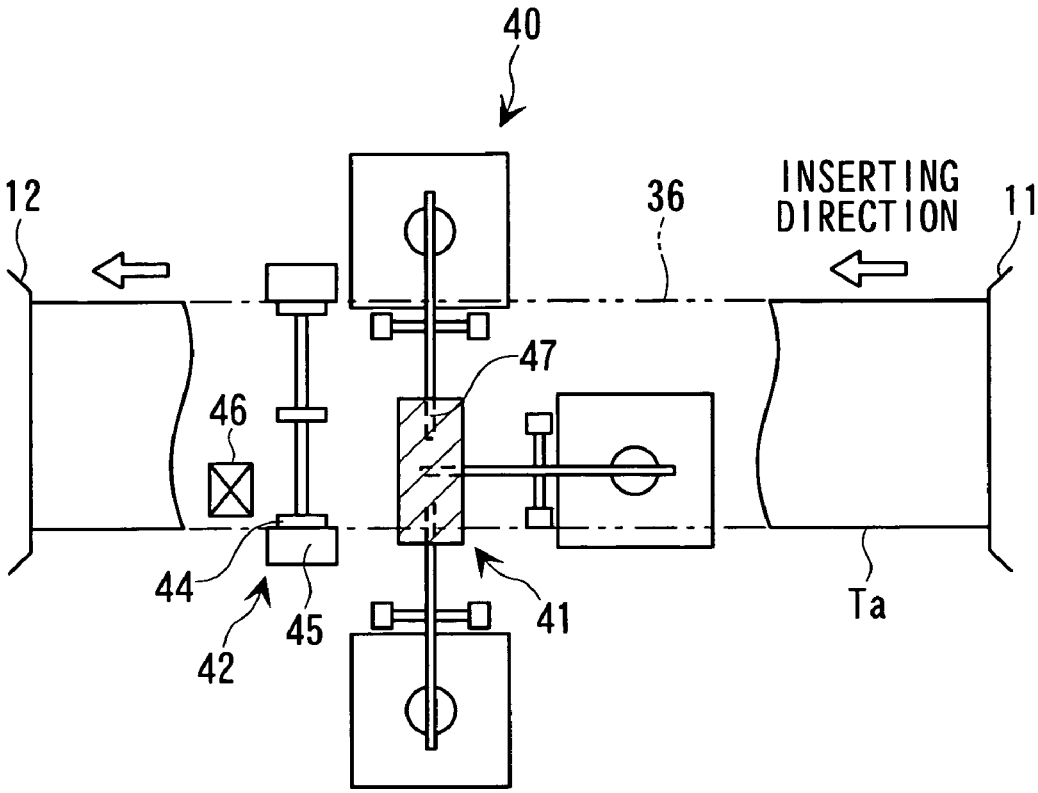
FIGS. 3A and 3B are plan view and sectional view, respectively, of an embossing unit.

As shown in FIG. 3A, the embossing assembly 40 faces a tape traveling passage 36 which linearly connects the embossing tape inserting portion 11 and the embossed tape discharging portion 12, and is made up of an embossing unit 41 (Braille embossing device) and a tape feed unit 42. The embossing unit 41 for performing Braille embossing is disposed on that widthwise half side of the tape which is on the side of the cartridge mounting portion 6. The tape feed unit 42 feeds the tape piece Ta manually inserted from the embossing tape inserting portion 11 toward the embossed tape discharging portion 12.

The tape feed unit 42 is made up of: a feed roller 44 which feeds through rotation the tape piece Ta; a roller shaft bearing 45 which rotatably supports the feed roller 44; an embossing feed motor 43 (see FIG. 4) which is capable of rotating the feed roller 44 and which is rotatable in normal direction and reverse direction; a power transmitting mechanism (not shown) which transmits the power of the embossing feed motor 43 to the feed roller 44; and a front end detecting mechanism 46 which detects the front end of the tape piece Ta to be fed. When the embossing feed motor 43 is driven, the feed roller 44 is rotated through the power transmission mechanism, whereby the tape piece Ta is fed. Then, the front end of the tape piece Ta being fed is detected by the front end detecting mechanism and, with this detection serving as a trigger, the embossing of Braille by means of the embossing unit 41 is started.

Figure 3B:
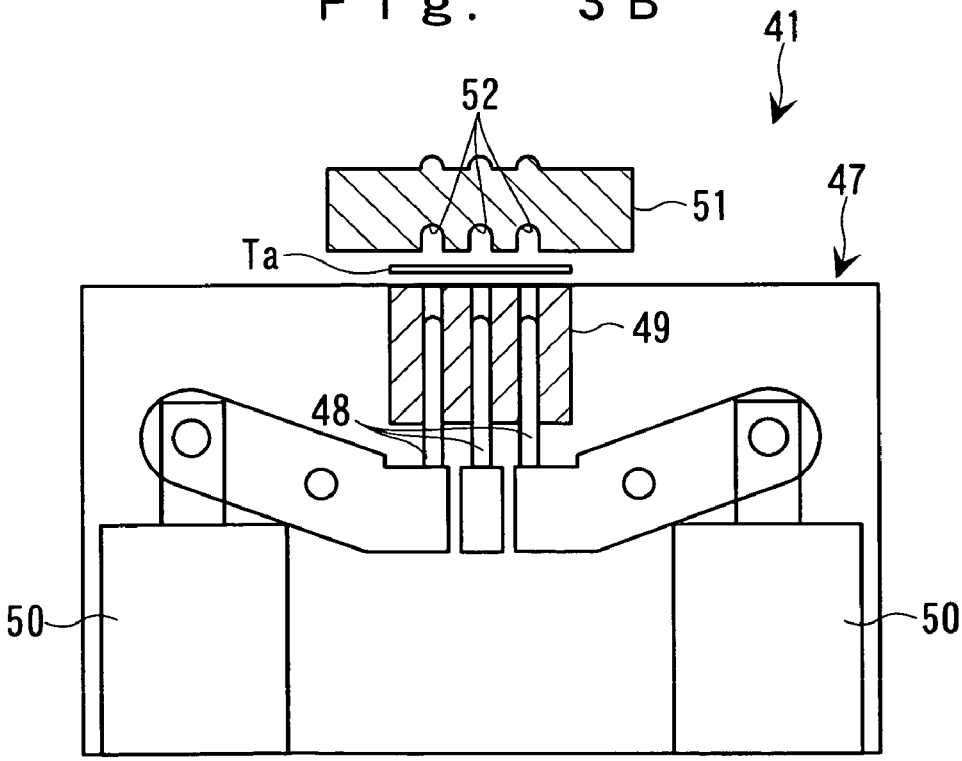

The embossing unit 41 is disposed on an upstream side (FIG. 3A), as seen in the direction of tape feeding, of the feeding roller 44 and is made up, as shown in FIG. 3B, of an embossing portion 47 which is disposed below the inserted tape piece Ta; and an emboss receiving portion 51 which is disposed in a position opposite to the embossing portion 47. The embossing portion 47 is made up of: three embossing pins 48 disposed to correspond to the vertically arrayed three embossing salients out of six embossing salients which constitute six-point Braille; an embossing guide block 49 which guides the embossing operation of the three embossing pins 48 so as to be movable back and forth; and three solenoids 50 which serve as the driving sources. The emboss receiving portion 51 has formed therein three receiving grooves 52 which correspond to the three embossing pins 48. While feeding the tape piece Ta by means of the tape feed unit 42, the three embossing pins 48 are selectively swung up toward the receiving groove 52 to thereby perform embossing operation with the three solenoids 50 serving as the driving source. The embossing salients of the six-point Braille are thus formed on the tape piece Ta.

Figure 4:
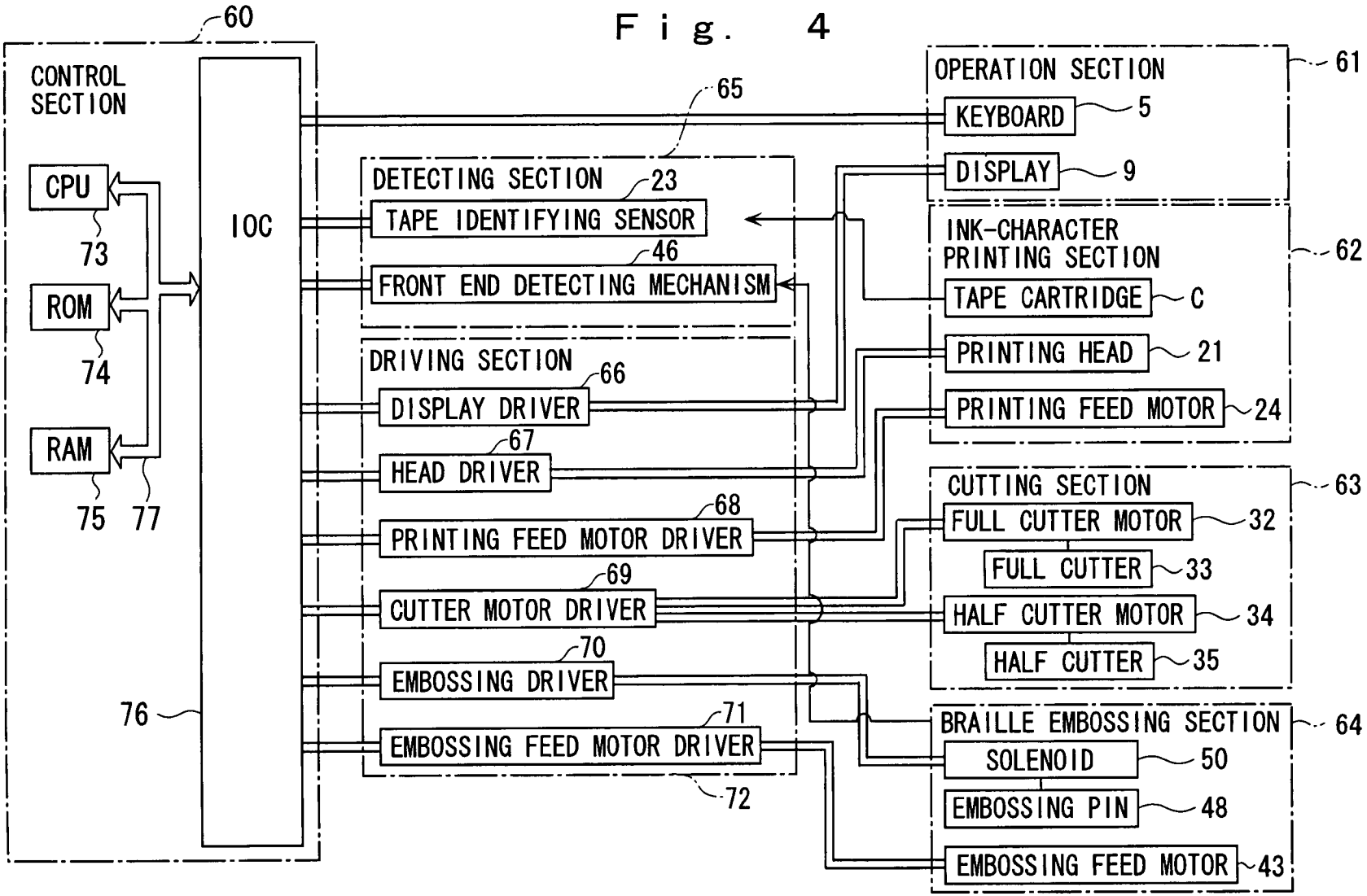
FIG. 4 is a control block diagram of the label producing apparatus.

With reference to FIG. 4, a description will now be made about the constitution of the control system of the label forming apparatus 1. The label forming apparatus 1 is made up of: an operating section 61 which has the keyboard 5 and the display 9 and governs the user interface such as the inputting by the user of the character information, displaying of various information, or the like; the ink-character printing section 62 which has the tape cartridge C, the printing head 21, and the printing feed motor 24 and performs printing on the processing tape T based on the inputted character information while feeding the processing tape T and the ink ribbon R; and a cutting section 63 which has the full cutter 33, the half cutter 35 as well as the full cutter motor 32 and the half cutter motor 34 for driving the above and performs the full cutting and half cutting on the printed processing tape T.

The label forming apparatus 1 further includes: the Braille embossing section 64 which has the solenoids 50, the embossing pins 48, and the embossing feed motor 43 and performs embossing of Braille while feeding the tape piece Ta according to the embossing data included in the label data based on character information; the detecting section 65 which has various sensors such as the tape identifying sensor 23, the front end detecting mechanism 46, or the like, and performs various detections; the driving section 72 which has a display driver 66, a head driver 67, a printing feed motor driver 68, a cutter motor driver 69, an embossing driver 70 and an embossing feed motor driver 71, and drives each of the above; and the control section 60 which controls the entire label forming apparatus 1.

The control section 60 is provided with a CPU 73, a ROM 74, a RAM 75, and an input control apparatus (input output controller, IOC) 76, each being connected to one another by an internal bus 77. In the control section 60, the CPU 73 inputs various signals/data from each part of the label forming apparatus 1 through the IOC 76 based on the control program inside the ROM 74 and, based on the inputted various signals/data, various data is processed based on the inputted various signal/data.

For example, the control section 60 (ROM 74) has stored therein software (data preparing program) for producing the label data. The control section 60 processes the input data (according to the data preparing program) such as the inputted character data, various set data, or the like, to thereby prepare the printing data and/or embossing data which form the label data. Thereafter, based on the prepared printing data and/or embossing data, the ink-character printing section 62, the cutting section 63, and the Braille embossing section 64 are driven and controlled, thereby forming a label.

A description will now be made about the method of producing a label data. When the data producing apparatus 1 is switched on, an input screen for use in inputting the input data is displayed on the display 9 according to the data producing program (see FIG. 5). In the data producing program, there are prepared the following two modes as the input mode for the input data, i.e., "printing input mode" for inputting character information/various setting data (hereinafter referred to as printing input data) for producing printing data, and "Braille input mode" for inputting character information/various setting data (hereinafter referred to as Braille input data) for producing embossing data. It is so arranged that the printing input data and the Braille embossing data which serve as input data can be respectively inputted from the exclusively used input screens.

Figure 5:
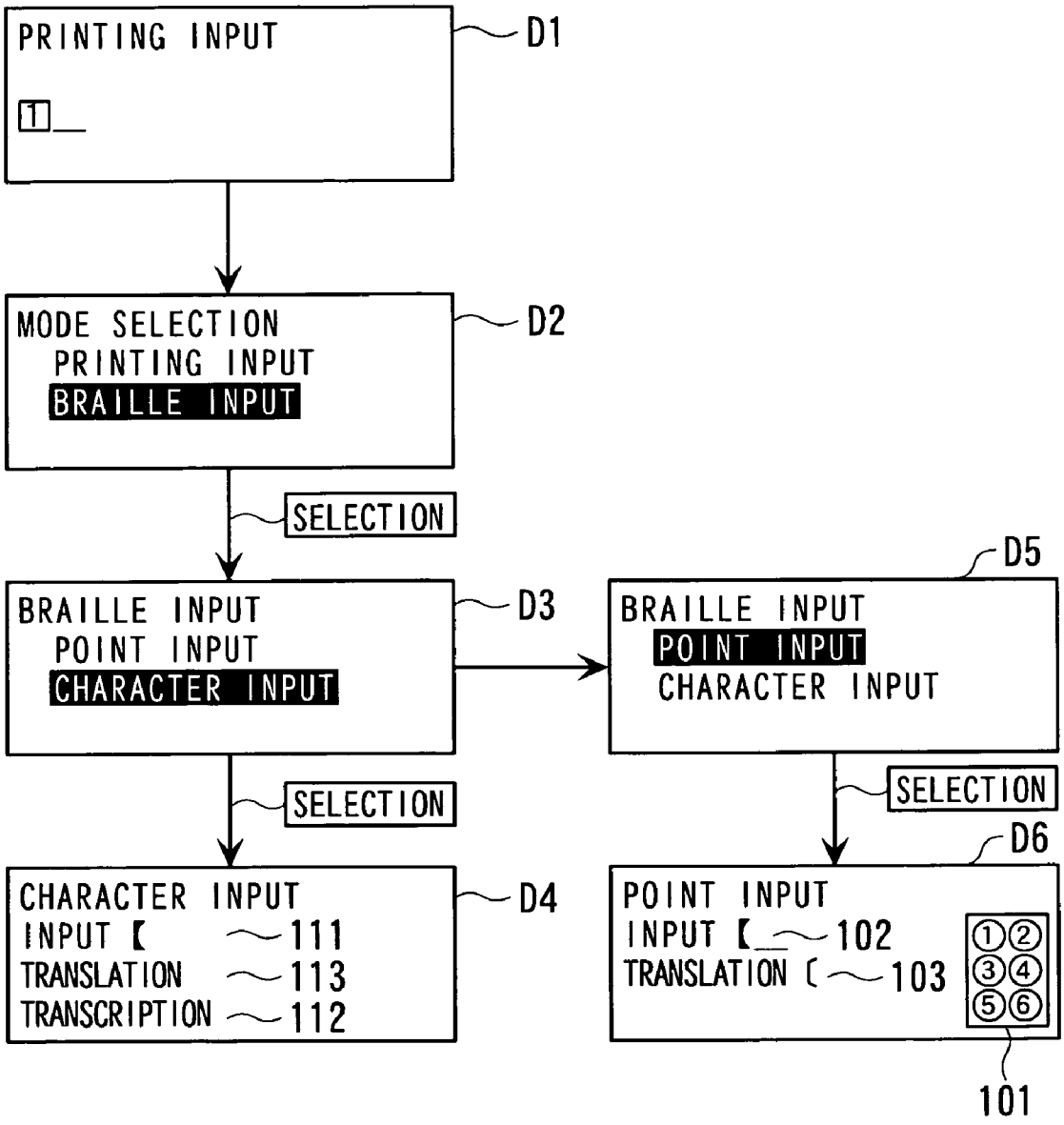
FIG. 5 is a flow diagram showing a series of screen displays from the selection of a Braille input mode to a display of input screen of point inputting or input screen of character inputting.

As shown in FIG. 5, the setting of the input mode is performed by the mode selection menu. It is so arranged that, if a predetermined key is operated in a state in which the input screen is displayed (D1), the mode selection menu is displayed (D2). Here, if the "printing input mode" is selected, the input screen for printing input mode is displayed (see D1), and becomes a state in which the character inputting of the character information of the printing input data can be made. In this embodiment, "printing input mode" is set as default and, therefore, the input screen for printing input mode is displayed at the time of switching on, or the like, of the apparatus (see D1).

On the other hand, if the "Braille input mode" is selected, there is displayed in succession an input method selection menu for selecting the method of character inputting of Braille (D3). It is so arranged that a further selection can be made between "point input" in which Braille input is made by point inputting of directly designating the embossing points which constitute Braille and "character input" in which the character information of Braille is inputted by characters (character input).

When the "point input" is selected (D5), there is displayed an input screen for point input which is the Braille input mode (D6). The input screen for point input has an emboss point designating portion 101, an inputted Braille notation portion (or indicating portion) 102, and a portion 103 for notating (or indicating) Braille as translated into ink characters (also referred to as "ink-character translation notation portion 103"). If the embossing point or points within a cell are designated and determined in the emboss point designating portion 101, the character information in Braille is inputted as Braille input data. The inputted Braille is notated in Braille character or characters in the inputted Braille notation portion 102, and also the ink-character translation (in Japanese katakana) of the inputted Braille is notated in the ink-character translation notation portion 103.

Once the "character input" is selected (D3), display is made of the input screen for character input which is the Braille input mode (D4). The input screen for character input has an inputted ink-character notation portion 111 which notates the inputted characters in ink characters (also referred to as "inputted ink-character notation for notating ink characters"), a portion 112 for notating the result of transcription into Braille of the inputted characters (also referred to as "produced Braille notating portion for notating transcription into Braille"), and a portion 113 for notating in ink characters the translation of Braille (also referred to as "produced ink-character notating portion for notating translation of Braille"). When characters are inputted from the input screen for characters, the inputted characters are displayed, first, in ink characters in the inputted ink-character notation portion 111. When a given key is operated (e.g., depression of an "Emboss key", Braille translation data (written in a divided manner based on Braille rule) is prepared based on the inputted characters. Based on this Emboss translation data, Braille notation which is the result of transcription of characters denoted in the ink-character notation portion 111 into Braille is displayed in the Braille notating portion 112 for notating transcription of Braille, and its translation is displayed in Japanese katakana in the produced ink-character notating portion 113 for notating translation of Braille. This Braille translation data is stored in the RAM 75 as the Braille input data.

If a predetermined key is depressed after having inputted this kind of input data, the control section 60 causes a label data to be produced based on the inputted data. At this time, if the printing input data and the Embossing input data have been inputted, there is produced label data for preparing the label in which both the ink-character printing and the Braille embossing are performed (i.e., label including ink characters and Braille characters). In other words, as the label data, the printing data is produced from the printing input data and also the Braille data is produced from the Braille input data. In case there is no input of the Braille input data and only the printing input data is inputted as the input data, only the printing data is produced as the label data. In this manner, the label data for producing the label only for ink-character printing is produced. Similarly, in case there is no input of the printing input data and only the Braille input data is inputted as the input data, only the Braille data is produced as the label data. In this manner, the label data for producing only the label for Braille embossing (Braille label) is produced.

As the Braille, there are ordinary (general) Braille which notifies general (ordinary) sentences and information processing Braille which has notification rules different from those of the general Braille and notifies URL (uniform resource locator) or electronic mail address, or the like. In order to correctly notify the Braille, it is necessary to use the general Braille and information processing Braille independent of (or separate from) each other in accordance with the content of the sentences (information).

In the "character input" of this embodiment, there are prepared "general Braille mode" which is used in inputting characters for general Braille and "information processing Braille mode" which is used in inputting characters for information processing Braille. In this manner, by inputting the character information for general Braille and the character information for information processing Braille in character input modes which are different from each other, there can be produced, by the inputted characters, general Braille embossing data for embossing general Braille and information processing Braille embossing data for embossing information processing Braille (see FIGS. 6A and 6B).

In other words, depending on the contents of the inputted sentences, the characters are inputted by appropriately switching the modes between the "general Braille mode" and "information processing Braille mode." If the key is then operated for producing the Braille data, there will be produced Braille data in which the characters inputted in the general Braille mode are translated into general Braille and the characters inputted in the information processing Braille mode are translated into information processing Braille. After having produced the Braille data, if a predetermined key is operated, the following embossing data is produced. Namely, based on the Braille data translated into general Braille, general Braille embossing data of characters as inputted in the general Braille mode is produced and, based on the Braille data translated into information processing Braille, information processing Braille data of characters as inputted in the information processing Braille mode is produced. It is thus possible to prepare a Braille label in which the general Braille and the information processing Braille are used separately (or independent of each other).

In this embodiment, "general Braille mode" is set as default and the "general Braille mode" is first displayed whenever "character input" is selected. Switching between "general Braille mode" and "information processing Braille mode" is made on the mode switching screen which is displayed by operating predetermined keys (e.g., depressing shift key+Braille key).

It is needless to say that "point input" is for designating an embossing point or points of Braille. It is also possible to produce information processing Braille data by "point input" by designating the embossing point or points corresponding to the information processing Braille.

A description will now be made in concrete about a method of inputting label containing information processing Braille based on an example of forming label data of a Braille label having a sample text of "for details, see http://abc.com/". It is to be noted that, in FIGS. 6A, 6B, and others, the above sample text is in Japanese hirakana ("INPUT" column) which denotes inputted characters as they are and in Japanese katakana ("TRSNALATION" column) as translated for Braille according to particular rules of translation into Braille. In the figures, however, they are represented in English to facilitate understanding. Six-point Braille characters correspond to Japanese characters, not to English characters.

In the above denotation "for details, see http://abc.com/", the part "for details, see" is presumed to be notated in general Braille and the part "http://abc.com/" is presumed to be notated in information processing Braille.

Figure 6A:
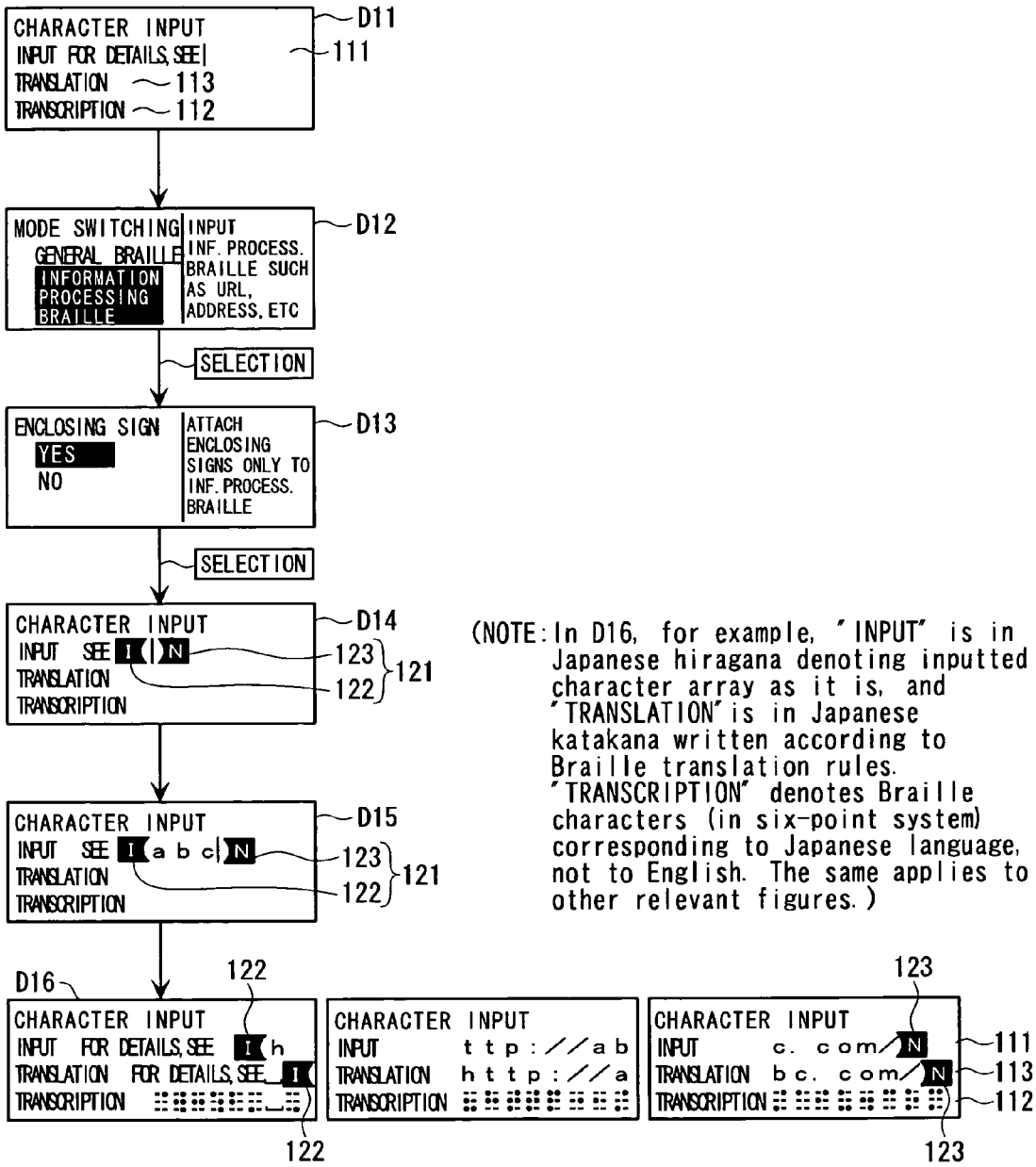
FIG. 6A is a flow diagram showing a series of screen displays from the input screen of character inputting to producing a label containing information processing Braille.

In case this Braille label is formed in "character input," the mode selection menu is first displayed. Then, "Braille input mode" and "character input" are sequentially selected to thereby display the input screen for character inputting (see FIG. 5). As shown in FIG. 6A, "for details, see" is inputted first (D11) and, by operating a predetermined key, the mode switching screen is displayed (D12). When "general Braille mode" is switched to "information processing Braille mode" on the mode switching screen, it becomes a state in which the character information for information processing Braille can be inputted in characters. Also, an indication mark is displayed by insertion to indicate that the information processing Braille is being inputted (D14). Reference mark D13 in the figure will be described hereinafter.

The indication mark 121 is made up of: a starting mark 122 which indicates the starting point of the information processing Braille and is shown by surrounding a character "I" with a substantially square figure ("I" as the first word of "Information" of information processing Braille); and an end mark "N" 123 which indicates the end point and is shown by surrounding a character "N" with a substantially square figure ("N" as the last word of "Information" of information processing Braille). When the character information of information processing Braille is inputted, the inputted characters are inserted into the space between the starting mark 122 and the end mark 123 (D15). As a result, it is arranged to be clearly recognized, among the inputted characters, as to in which range the information processing Braille is inputted.

After having finished character input of "http://abc.com/" in information processing Braille mode, the key is operated for producing Braille translation data. Braille translation data for translating the portion "for details, see" is produced and is inputted as Braille input data. Based on the produced Braille translation data, "http://abc.com/" as notated in the information processing Braille is displayed in the Braille notating portion 112 for notating transcription into Braille and also the ink-character translation thereof is displayed in the ink-character notating portion 113 for notating translation of Braille (D16). In this case, the ink-character translation corresponding to the information processing Braille is also displayed in a manner sandwiched between the indicating mark 121.

After the display has been made, based on the Braille translation data, in the Braille notating portion 112 for notating transcription into Braille and the ink-character notating portion 113 for notating translation of Braille, a predetermined key is operated. The translation data is then converted into the embossing data. As a result, there is produced a label data for notating the part "for details, see" in general Braille and the part "http://abc.com/" in information processing Braille, respectively.

The information processing Braille is arranged to be enclosed by a starting mark 132 showing the starting point of the information processing Braille and an end mark 133 which shows the end point of the information processing Braille. In case the information processing Braille is used, it is preferable that the range is clarified by the enclosing sign 131 (see FIG. 6B). However, the enclosing sign 131 requires a total of four cells made up of two cells in the starting mark 132 and two cells in the end mark 133. In case the number of Braille (number of cells) must be reduced to the extent possible such as in forming a label for attaching to a relatively small item such as a name card, it is estimated that the enclosing sign 131 should be omitted even when the information processing Braille is used.

Figure 7A:
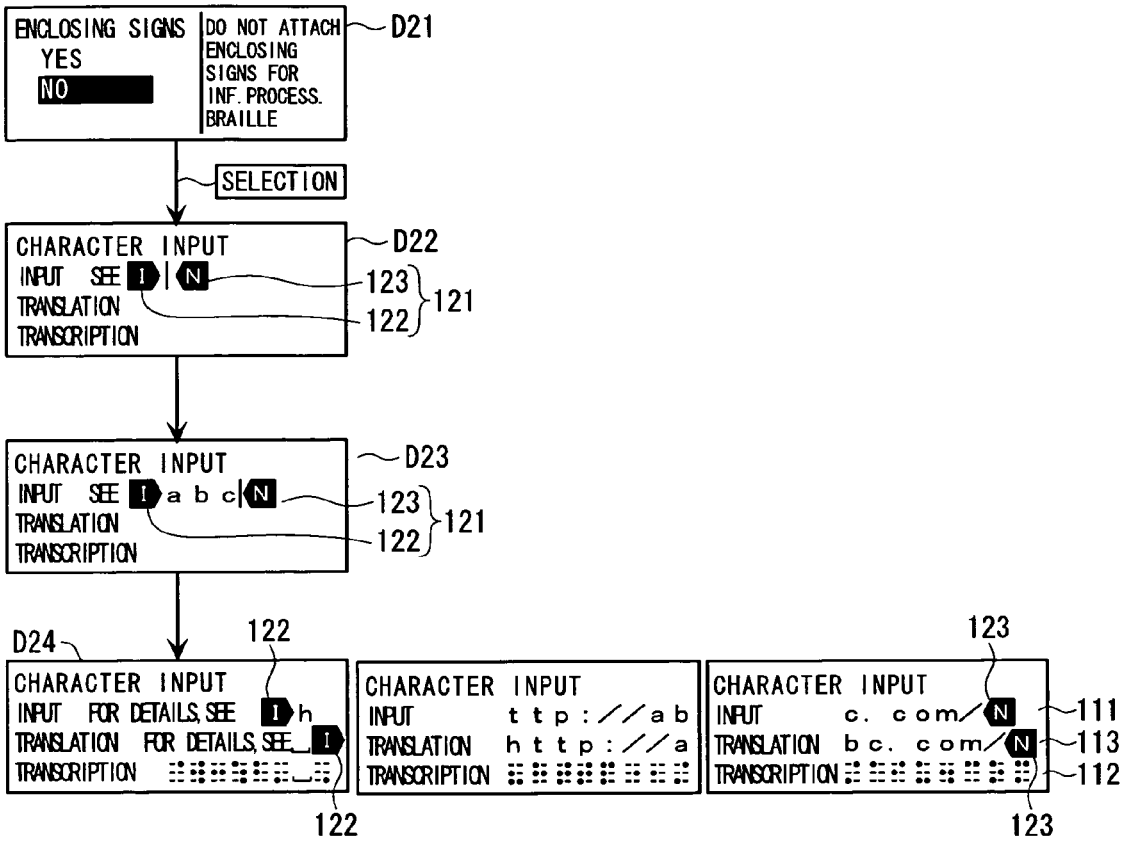
FIG. 7A is a flow diagram showing a selection screen of setting as to whether or not enclosing signs shall be added to the information processing Braille and a series of screen displays in which a selection is made not to add the enclosing signs.
Figure 7B:
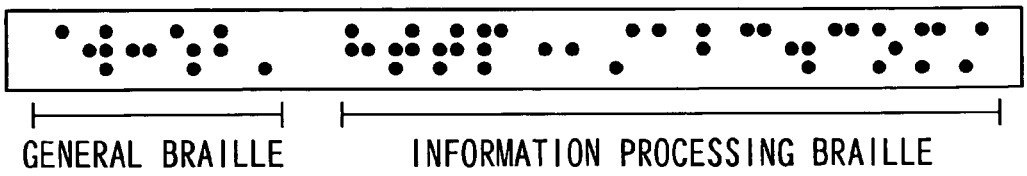
FIG. 7B is a label showing the result of processing in FIG. 7A.

To meet such a requirement, in this embodiment, the following arrangement is employed. Namely, when the "information processing Braille mode" is selected in the mode selection screen, prior to displaying the input screen, a display is made of a mark setting screen for selecting as to whether an enclosing sign 131 should be attached to the information processing Braille (D13). It is thus so arranged that a selection can be made whether the enclosing sign 131 should be attached or not. If a selection of "yes" is made in the enclosing mark setting screen, there is produced translation data attached with enclosing mark data for inserting the enclosing sign 131 in front of, and at the back of, the information processing Braille. If "no" is selected, there is produced translation data without enclosing mark data (FIG. 7A, D21–D24).

Figure 6B:
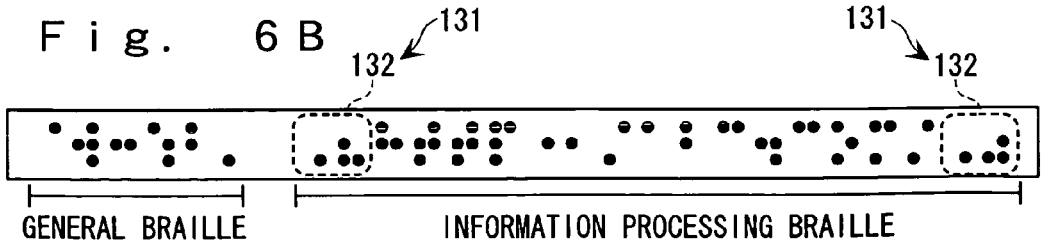
FIG. 6B is a label showing the result of processing in FIG. 6A.

In this case, the indication mark also serves the purpose of showing the presence or absence of the enclosing mark. As shown in FIGS. 6A, 6B and 7A, it is so arranged that a different mark indication is made in case "yes" is selected and in case "no" is selected in the enclosing mark setting screen. In concrete, if "yes" is selected, the starting mark 122 and the end mark 123 are displayed such that the substantially square mark is recessed on the side of the information processing Braille. If "no" is selected, the starting mark 122 and the end mark 123 are displayed such that the substantially square mark is projected on the side of the information processing Braille.

Figure 8:
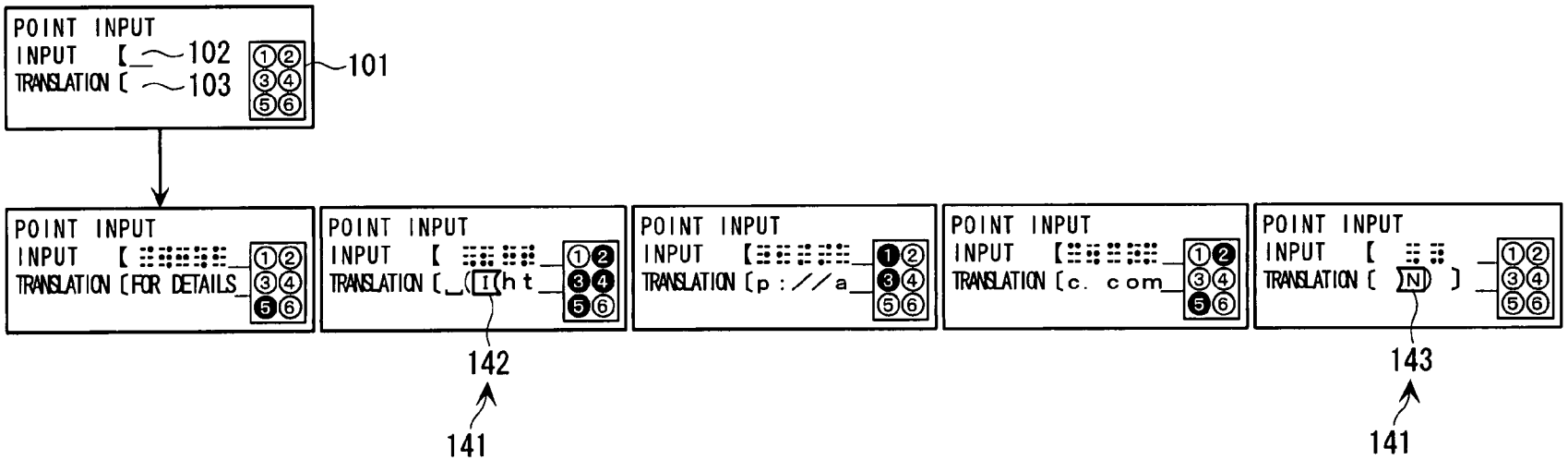
FIG. 8 is a flow diagram showing the procedure of producing a label containing information processing Braille from the input screen of point inputting.

On the other hand, in case the label data of the Braille label having a notation of "for details, see http://abc.com/", selection is sequentially made of the "Braille input mode" and "point input" as in the case of the "character input" to thereby display the input screen for point inputting (see FIG. 5). Then, as shown in FIG. 8, by using the embossing point designation portion 101, input is made of the Braille "for details, see" by one cell each time, according to the notation rule of the general Braille. Once the Braille "for details, see"

has been inputted, Braille is inputted according to the rule of information processing Braille. In concrete, the embossing point or points of each Braille (cell) are designated by the embossing point designation portion 101 and the starting mark 132 of the enclosing sign 131 is inputted. Subsequently, according to the rule of the information processing Braille, an input is made of "http://abc.com/" and the end mark 133 of the enclosing sign 131 is inputted.

At this time, the ink-character notating portion 113 for notating translation of Braille displays the ink-character translation up to the part "for details, see" according to the notation rules of the general Braille. From the starting mark 132 downward, Braille transcription is displayed according to the rules of the information processing Braille. Therefore, in case Braille input of the information processing Braille is not made in the Braille input after the enclosing sign 131, an appropriate ink-character translation is not displayed in the ink-character translation notation portion 103. Therefore, even if the user wrongly inputs the general Braille after having inputted the enclosing sign 131, the mistake can easily be recognized. In addition, as shown in FIG. 8, once the enclosing sign 131 is inputted, an enclosing sign mark 141 which corresponds to the enclosing sign is displayed in the ink-character translation notation portion 103. The enclosing sign mark 141 is made up of a starting sign mark 142 which corresponds to the starting sign 132, and an end sign mark 143 which corresponds to the end sign 133. The enclosing sign mark 141 is displayed in a manner different from that of the indicating mark 121. In this embodiment, the indicating mark 121 is negatively indicated (in reverse video) and the enclosing sign mark 141 is positively indicated (in normal video) (see FIGS. 6A and 6B).

According to the tape forming apparatus 1 to which the invention is applied, as the Braille input mode, there are provided "general Braille mode" for inputting Braille input data of general Braille and "information processing Braille mode" for inputting Braille input data of information processing Braille. Therefore, there can be produced label data which can emboss both the general Braille and information processing Braille. In case a label with Braille notation is produced, these modes can be appropriately switched in inputting input characters depending on the contents of the sentences to be inputted, whereby label data is produced. In this manner, Braille labels can be produced by separately or independently using the general Braille and the information processing Braille. In addition, by means of character input, the general Braille and the information processing Braille can be inputted. Therefore, it is easy even for the user who is not familiar with the Braille to produce Braille labels in which the general Braille and the information processing Braille are used separately or independent of each other.

It is further understood by those skilled in the art that the foregoing is the preferred embodiment of the invention, and that various changes and modifications may be made without departing from the spirit and scope thereof.

What is claimed is:

1. A data producing method for a data producing apparatus, the apparatus comprising:

a first Braille translation device which produces information processing Braille data for embossing information processing Braille on a processing sheet based on an ink-character array made up of one or more ink characters;

a second Braille translation device which produces general Braille data for embossing general Braille, other than the information processing Braille, on the processing sheet based on the ink-character array, thereby producing from the inputted ink-character array Braille data made up of the information processing Braille data and/or the general Braille data, the method including:

when designation of producing part or all of the inputted ink-character array in information processing Braille is made, producing the information processing Braille data with the first Braille translation device for the designated portion; and when designation of producing in general Braille is made, producing the general Braille data with the second Braille translation device for the designated portion.

2. A data producing apparatus comprising:

a first Braille translation device which produces information processing Braille data for embossing information processing Braille on a processing sheet based on an ink-character array made up of one or more ink characters;

a second Braille translation device which produces general Braille data for embossing general Braille, other than the information processing Braille, on the processing sheet based on the ink-character array; and a Braille kind designation device which designates whether part or all of the inputted ink-character array shall be produced in information processing Braille or general Braille; and a Braille data producing device which produces, based on a result of designation by the Braille kind designation device, the information processing Braille data with the first Braille translation device for the portion in which producing by information processing Braille of the ink-character array is designated, and which produces the general Braille data with the second Braille producing device for the portion in which producing by general Braille of the ink-character array is designated, thereby producing Braille data which is made up of information processing Braille data and general Braille data from the inputted ink-character array.

3. The apparatus according to claim 2, further comprising a first display device for displaying: inputted ink-character notation for notating ink characters based on the inputted ink-character array; produced Braille notation for notating transcribed Braille based on the produced Braille data; and produced ink-character notation of Braille for notating the ink-character translation of the Braille.

4. The apparatus according to claim 3, wherein the first display device comprises an indication mark display device which displays by indicating the portion corresponding to the general Braille separately from at least one of the portions of the inputted ink-character notation and produced ink-character notation corresponding to the information processing Braille, at a time of displaying the information processing Braille as the produced Braille notation.

5. The apparatus according to claim 4, wherein the indication mark display device respectively inserts as the indication mark display: a starting mark in a position corresponding to a position of starting the information processing Braille in the inputted ink-character notation and the produced ink-character notation; and an end mark in a position corresponding to a position of ending the information processing Braille in the inputted ink-character notation and the produced ink-character notation.

6. The apparatus according to claim 2, further comprising an enclosing sign setting device which sets, when the Braille kind designation device has selected producing in the information processing Braille, as to whether enclosing signs shall be added to the information processing Braille data produced by the first Braille translation device to indicate a starting point and an end point of the information processing Braille, wherein the Braille data producing device produces, when setting is made to add the enclosing signs, the Braille data in which enclosing data to emboss the enclosing signs is added to the information processing Braille data produced by the first Braille translation device.

7. The apparatus according to claim 6, further comprising: a first display device for displaying an inputted ink-character notation for notating ink characters based on the inputted ink-character array, produced Braille notation for notating the transcription of Braille based on the produced Braille data, and produced ink-character notation for notating the translation of the Braille, wherein the first display device includes an indication mark display device which displays by indicating the portion corresponding to the general Braille separately from at least one of an inputted ink-character notating portion and a produced ink-character notating portion corresponding to the information processing Braille, and wherein the indication mark display device displays the indication mark in a different indicating mode, based on a result of setting by the enclosing sign setting device, between a case in which the enclosing signs are embossed and a case in which the enclosing signs are not embossed.

8. The apparatus according to claim 2, further comprising: Braille data input device which inputs the Braille data; and ink-character translation device which translates the Braille data into the ink-character array.

9. The apparatus according to claim 8, further comprising a second display device which displays an input Braille notation which notates the Braille based on the inputted Braille data and input ink-character translation notation which notates ink-character translation of the input Braille notation.

10. The apparatus according to claim 9, wherein, when the enclosing sign data to emboss the enclosing signs showing the starting point and the end point of the information processing Braille is inputted by the Braille data input device as the Braille data, the second display device displays in the input ink-character translation notation an enclosing sign mark corresponding to the enclosing sign data.

11. A sheet processing apparatus comprising:

the data producing apparatus according to claim 2; and an embossing device which embosses Braille on the processing sheet based on the Braille data produced by the data producing apparatus.

* * * * *